US008997727B1

(12) United States Patent
Hamel et al.

(10) Patent No.: US 8,997,727 B1
(45) Date of Patent: Apr. 7, 2015

(54) PROJECTILE SHOOTER TOY

(75) Inventors: Daniel Roger Hamel, Ludlow, MA (US); David Baird, Westfield, MA (US)

(73) Assignee: Hasbro, Inc., Pawtucket, RI (US)

( * ) Notice: Subject to any disclaimer, the term of this patent is extended or adjusted under 35 U.S.C. 154(b) by 420 days.

(21) Appl. No.: 13/455,293

(22) Filed: Apr. 25, 2012

(51) Int. Cl.

| | |
|---|---|
| ***F41B 7/08*** | (2006.01) |
| ***F41B 7/00*** | (2006.01) |
| ***A63H 33/18*** | (2006.01) |
| *F41B 4/00* | (2006.01) |

(52) U.S. Cl.
CPC ..... *F41B 7/003* (2013.01); *A63H 33/18* (2013.01); *F41B 7/08* (2013.01); *F41B 4/00* (2013.01); *F41B 7/006* (2013.01)

(58) Field of Classification Search
CPC ..... F41B 7/08; F41B 4/00; F41B 7/003; A63H 33/18; A63H 9/02; A63H 2208/12
USPC ..... 124/6, 10, 16, 42, 81; 446/473
See application file for complete search history.

(56) References Cited

U.S. PATENT DOCUMENTS

| | | | | | |
|---|---|---|---|---|---|
| 2,129,461 | A | * | 9/1938 | Boerger | 124/10 |
| 2,816,536 | A | * | 12/1957 | Profitt | 124/10 |
| 3,018,584 | A | * | 1/1962 | Passariello | 446/259 |
| 3,487,824 | A | * | 1/1970 | Profitt | 124/10 |
| 3,717,136 | A | * | 2/1973 | Gay et al. | 124/21 |
| 4,016,854 | A | * | 4/1977 | Lehman | 124/27 |
| 4,170,215 | A | * | 10/1979 | Kettlestrings | 124/16 |
| 4,248,202 | A | * | 2/1981 | Jaworski et al. | 124/16 |
| 4,277,068 | A | * | 7/1981 | Sasaki | 473/511 |
| 4,318,388 | A | * | 3/1982 | Fogarty et al. | 124/10 |
| 4,871,170 | A | * | 10/1989 | Carini | 273/126 R |
| 4,910,646 | A | * | 3/1990 | Kim | 362/112 |
| 5,186,156 | A | | 2/1993 | Clayton | |
| 5,199,410 | A | * | 4/1993 | Cheng | 124/10 |
| 5,253,873 | A | * | 10/1993 | Grattan | 473/511 |
| 5,373,975 | A | | 12/1994 | Husted | |
| 5,377,656 | A | * | 1/1995 | Lewinski et al. | 124/65 |
| 5,471,967 | A | * | 12/1995 | Matsuzaki et al. | 124/6 |
| 5,611,322 | A | * | 3/1997 | Matsuzaki et al. | 124/6 |
| 5,613,482 | A | * | 3/1997 | Thai et al. | 124/16 |
| 5,692,489 | A | | 12/1997 | Swanson et al. | |
| 5,762,058 | A | | 6/1998 | Cheng et al. | |
| 5,782,228 | A | * | 7/1998 | Wu | 124/6 |
| 5,996,564 | A | * | 12/1999 | Kotowski | 124/6 |
| 6,015,328 | A | | 1/2000 | Glaser | |
| 6,048,280 | A | | 4/2000 | Palmer et al. | |
| 6,116,229 | A | * | 9/2000 | Wu | 124/6 |
| 6,224,457 | B1 | * | 5/2001 | Wu | 446/473 |
| 6,298,841 | B1 | | 10/2001 | Cheng et al. | |
| 6,460,527 | B1 | * | 10/2002 | Doepner | 124/16 |
| 6,523,535 | B2 | * | 2/2003 | Rehkemper et al. | 124/78 |
| 6,648,726 | B2 | | 11/2003 | Hornsby et al. | |
| 6,758,203 | B1 | * | 7/2004 | Wu | 124/6 |

(Continued)

*Primary Examiner* — Melba Bumgarner
*Assistant Examiner* — Alexander Niconovich
(74) *Attorney, Agent, or Firm* — Perry Hoffman

(57) ABSTRACT

A projectile shooter toy has a body with a sidewall forming a space for holding a projectile in a loaded state and a pathway leading away from the space and along which the projectile moves in a forward direction. An actuator is arranged to engage the projectile to move the projectile forward along the pathway. At least two pinching members are spaced forwardly along the pathway from the actuator. The pinching members are separate from, and movable relative to, the actuator and the sidewall, and are configured to exert a force on the projectile as the projectile passes between the at least two pinching members.

20 Claims, 7 Drawing Sheets

(56) References Cited

U.S. PATENT DOCUMENTS

| | | | | |
|---|---|---|---|---|
| 6,915,793 | B2 * | 7/2005 | Vanek et al. | 124/78 |
| 7,004,813 | B2 * | 2/2006 | Zuloff | 446/175 |
| 7,051,727 | B2 * | 5/2006 | Wu | 124/6 |
| 7,108,576 | B2 * | 9/2006 | LaPointe | 446/47 |
| 7,278,417 | B2 | 10/2007 | Ciesiun | |
| 7,430,825 | B2 | 10/2008 | Vanek et al. | |
| 7,673,624 | B2 * | 3/2010 | Rosella, Jr. | 124/10 |
| 2001/0051488 | A1 | 12/2001 | Tachau et al. | |
| 2002/0134366 | A1 * | 9/2002 | Rehkemper et al. | 124/78 |
| 2002/0166551 | A1 * | 11/2002 | Lee | 124/78 |
| 2013/0112184 | A1 * | 5/2013 | Corsiglia et al. | 124/78 |

* cited by examiner

PROJECTILE SHOOTER TOY

BACKGROUND OF THE INVENTION

1. Field of the Invention

The subject matter disclosed herein relates to toys and more particularly to a projectile shooter toy that launches a projectile such as a disc.

2. Description of the Related Art

Many kinds of shooting toys exist and are designed for the amusement of children and adults alike. Shooting toys come in various shapes to simulate a shooting action in a battle with competing sides whether for role playing or a game. Thus, the shooting toy is commonly shaped to be hand-held or may be in the shape of an armed vehicle or transport for example. In order to provide an entertaining toy, the shooting toy typically has sufficient strength to launch the projectile an entertaining distance rather than merely dropping the projectile directly out of the outlet or muzzle of the shooting toy. When such shooting toys are part of a game, it may be advantageous for the projectile to be ejected with sufficient force in order to contact targeted objects to knock down an opposing piece or article or otherwise cause a visible change in the impacted article to raise the entertainment level of such a game. However, these commonly known shooting toys may jam, use complex and costly firing mechanisms, and/or may be difficult for a child to use when relatively great strength is needed to fire the shooting toy. Thus, a shooting toy is desirable that overcomes these shortcomings.

SUMMARY OF THE INVENTION

The projectile shooter toy disclosed herein provides a cost effective, reliable, and/or easy to use fun and interesting toy by using pinching members that engage a projectile, such as a disc for example, to provide a relatively strong launching force. In one form, the pinching members also direct the projectile to remain along a firing pathway to increase the reliability of the shooter toy by reducing jams within the shooter toy. An actuator mechanism has a cost efficient plunger that may be biased without the use of separate coil springs and requires relatively little strength to press so that a small child can adequately operate the projectile shooter toy.

In one specific form, the projectile shooter toy has a body with a sidewall forming a space for holding a projectile in a loaded state, and a pathway leading away from the space and along which the projectile moves in a forward direction. An actuator is arranged to engage the projectile to move the projectile forward along the pathway. At least two pinching members are spaced forwardly along the pathway from the actuator, and are separate from, and movable relative to, the actuator and the sidewall. The pinching members are configured to exert a force on the projectile as the projectile passes between the at least two pinching members.

In another form, the projectile shooter toy has a body forming a space for holding a projectile in a loaded state, and a pathway leading away from the space and along which the projectile moves in a forward direction. An actuator has a plunger arranged to engage the projectile to move the projectile from the space and forward along the pathway. At least two pinching members are spaced forwardly along the pathway from the actuator and configured to exert a force on a projectile disposed between the at least two pinching members. In one form, at least one of the pinching members has a post generally extending transverse to a horizontal plane while the body is held so the pathway generally extends along the horizontal plane. In another aspect of the shooter toy, the post has a lateral projection for engaging the projectile, and a guide or indent on the lateral projection for directing the projectile to remain on the pathway.

In yet another form, the projectile shooter toy has a body with a sidewall forming a space for holding a projectile in a loaded state, and a pathway leading away from the space and along which the projectile moves in a forward direction. An actuator has a plunger for moving the projectile from the space and forward along the pathway. The plunger has a main portion with an end for engaging the projectile and a biasing portion biasing the plunger rearwardly away from the space. The biasing portion and the main portion are integrally formed as one piece.

BRIEF DESCRIPTION OF THE DRAWINGS

For the purpose of facilitating an understanding of the devices disclosed herein, the accompanying drawings and description illustrate alternative forms thereof, from which the inventions, structure, construction, operation, and many related advantages may be readily understood and appreciated.

DESCRIPTION OF THE PREFERRED EMBODIMENT

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1:
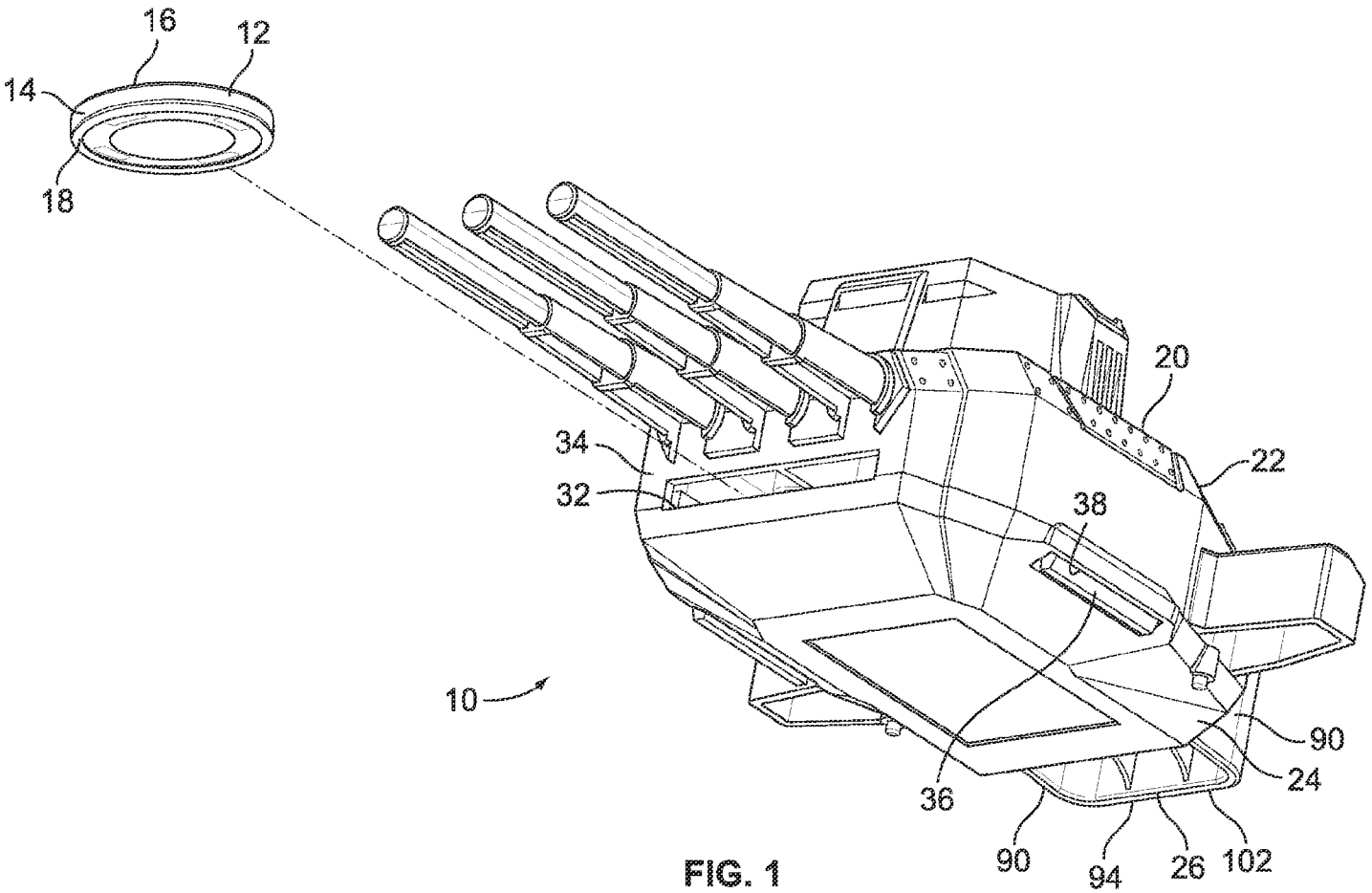
FIG. 1 is a lower perspective view of a projectile shooter toy as described herein.

Referring to FIG. 1, a projectile shooter toy 10 may be generally shaped to resemble a toy gun, wrist-mounted shooter, armament on other objects such as a tank, battleship, airplane, space ship, and so forth, or any other form that can fire a projectile such as a superhero doll. In the illustrated example, the projectile shooter toy 10 is in the shape of a battleship gun turret. In one form, the projectile shooter toy 10 launches projectiles 12 such as solid or annularly shaped discs with a circular outer rim 14. The outer rim 14 also may have a convexly curved or rounded shape as it extends from a top surface 16 to a bottom surface 18 of the disc (FIG. 5).

Referring to FIGS. 2-6, the illustrated projectile shooter toy 10 is made of five main parts including a body 20 formed of an upper piece or housing 22 and a lower piece or base 24, an actuator 26 to initiate the firing of the projectile 12, and at least two pinching members 28 and 30 to apply additional force to the projectile 12 as the projectile is being launched. At least one of the upper and lower pieces 22 and 24, and here both cooperatively, form an opening or exit slot 32 on an exterior wall such as a front exterior wall 34 of the body 20 to launch the projectile 12 from the body. It will be understood that the words upper and lower are used herein to indicate the position of the features on the projectile shooter toy 10 relative to each other and may be reversed or otherwise different unless stated herein.

Referring again to the illustrated example of FIG. 1, the upper and lower pieces 22 and 24 may be secured to each other by a snap-fit tab 36 on one of the pieces 22 or 24 that fits into a slot 38 on the opposite piece 22 or 24 to provide a detachable yet relatively strong connection to withstand the forces generated by firing of the projectile. Otherwise, it will be appreciated that many other connections may be used alternatively or additionally to attach the upper and lower pieces 22 and 24 together such as adhesives, plastic welding, and so forth to provide a strong connection. The present shooter toy 10 also uses screws to attach the lower and upper pieces 22 and 24 to each other.

Figure 2:
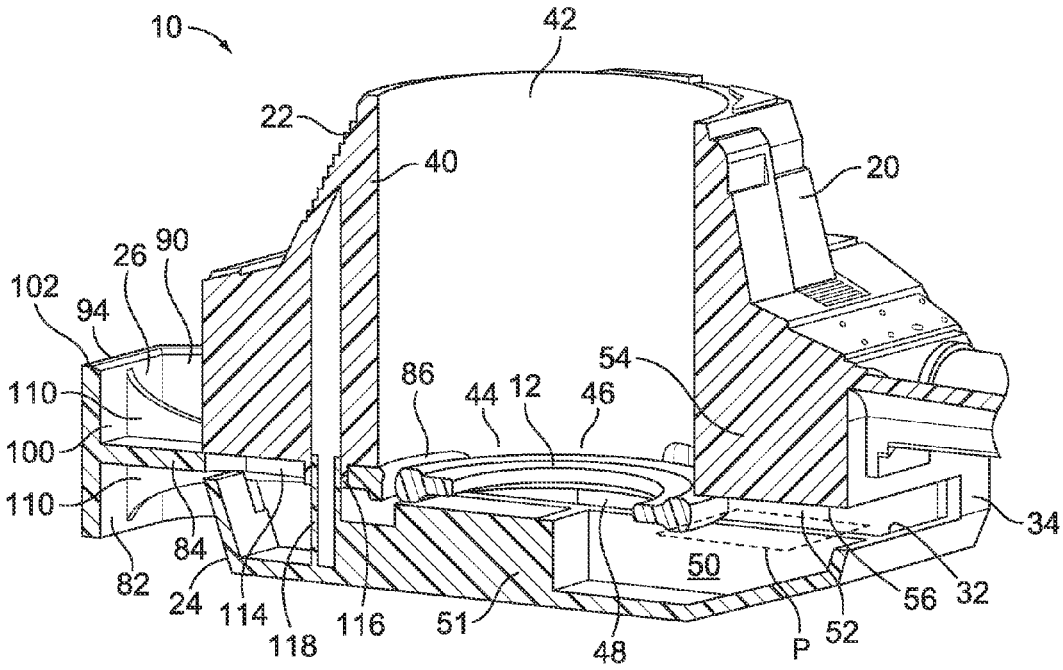
FIG. 2 is a longitudinal and cross-sectional view of the projectile shooter toy.
Figure 4:
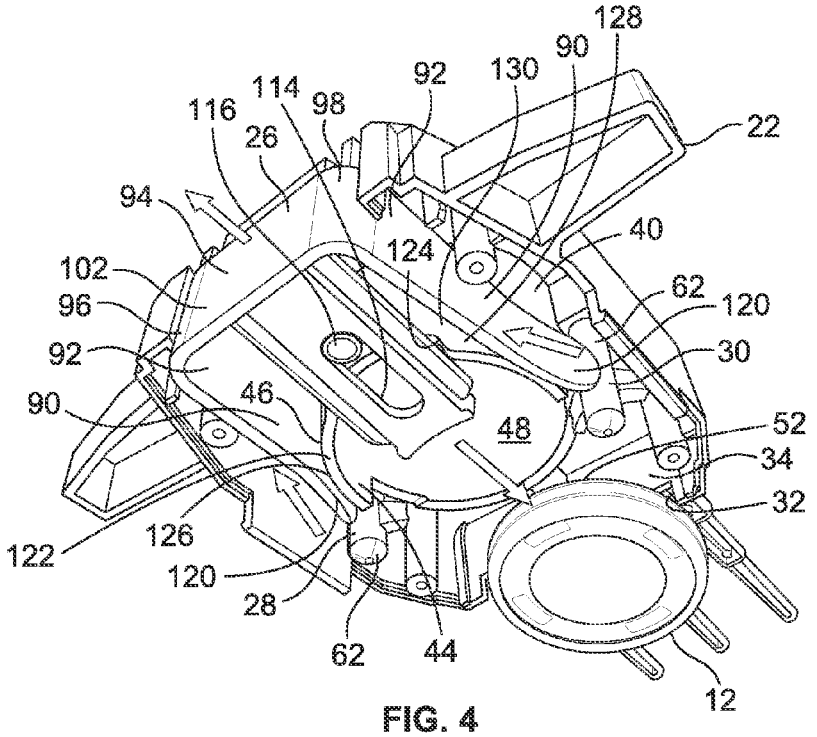
FIG. 4 is a lower perspective view of the projectile shooter toy with the bottom piece removed to show the projectile shooter toy in a firing state.
Figure 5:
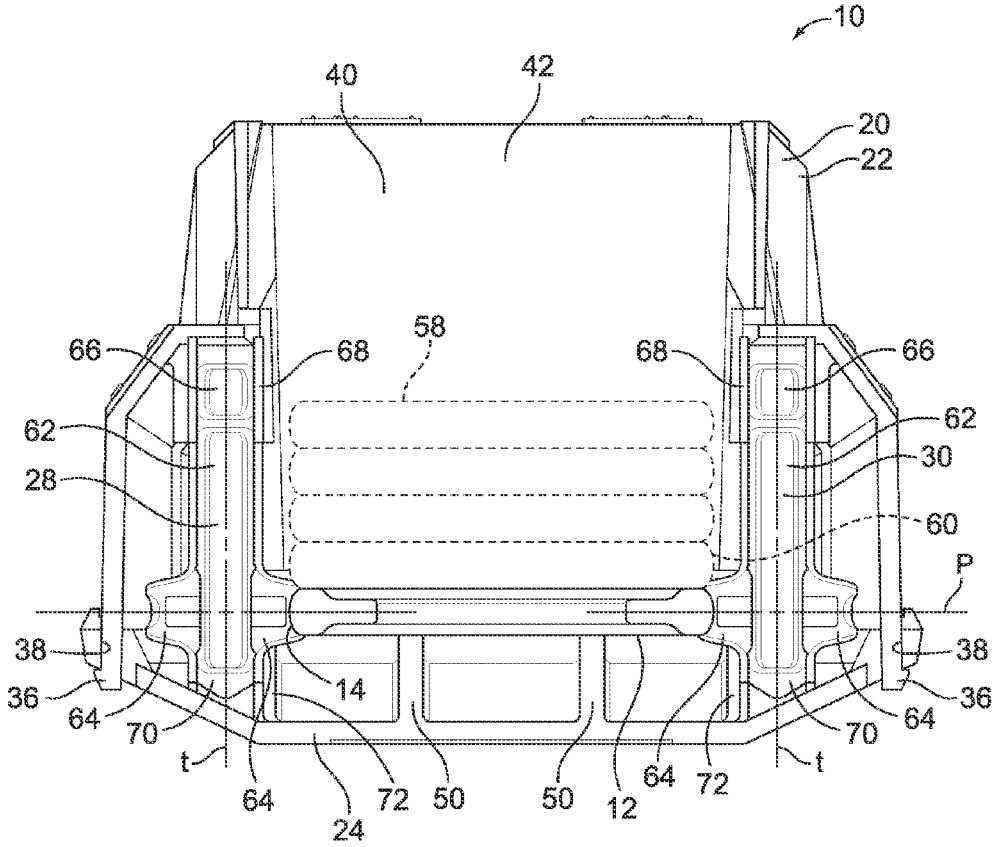
FIG. 5 is a front facing cross-sectional view of the entire projectile shooter toy while the projectile shooter toy is in a loaded state and located at line 5-5 on FIG. 3.

Referring to FIGS. 2 and 5, the upper piece 22 of the body 20 has a cylindrical wall 40 that forms a loading bore 42 for receiving one or more of the discs 12. A bottom portion 44 of the wall 40 forms a sidewall 46 (seen best in FIGS. 3-4) that defines a space 48 where the projectile or disc 12 sits to define a loaded state of the projectile shooter toy 10.

Figure 6:
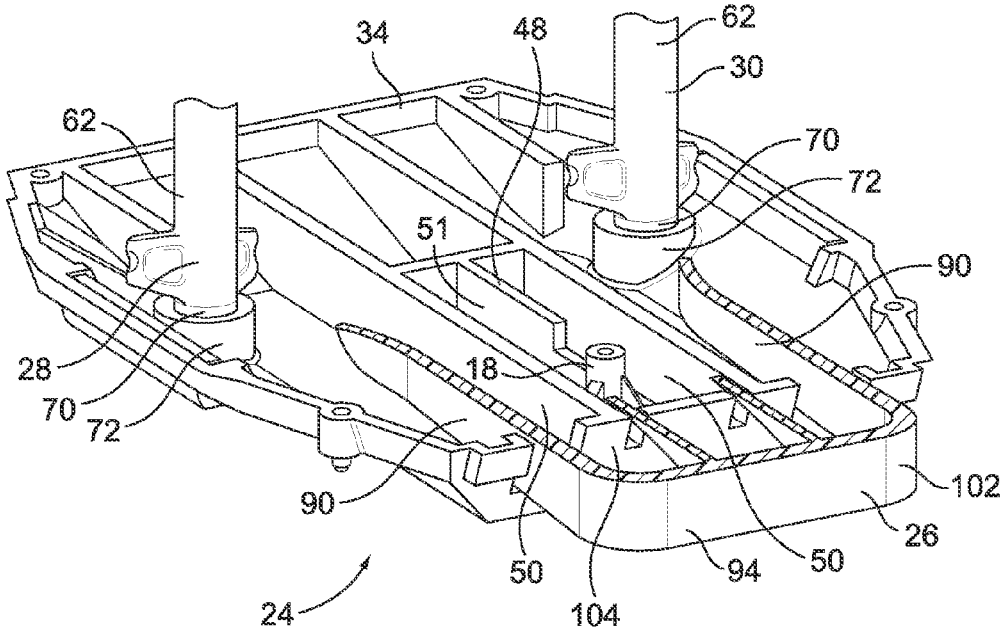
FIG. 6 is an upper perspective view of the bottom piece of the projectile shooter toy.

In the loaded state, the disc 12, while seated in the space 48, may be supported by two or more beam portions 50 and 51 of the lower piece 24 (FIGS. 5-6). The short beam portion 51 runs longitudinally along the center of the lower piece 24 at the space 48. The beam portions 50 extend longitudinally along the body 20 at least from the area of the space 48 to the front exterior wall 34 and slot 32. This forms a pathway 52 above the beam portions 50 and 51 and leading away from the space 48. The upper piece 22 has a downwardly extending beam or flange 54 to define a top 56 of a portion of the pathway 52 in an area forward from the space 48 and to maintain the disc 12 along the pathway 52 and toward the slot 32. So configured, the projectile 12 moves from the space 48 and along the pathway 52 in a forward direction. Forward here means a direction from the space 48 and toward the exterior of the body 20 but does not necessarily mean pointed toward a front of the body 20.

When the body 20 is configured to use a projectile 12 shaped as a disc, the pathway 52 generally defines a horizontal plane P (FIGS. 2 and 5) when the body 20 is positioned so that the loaded disc 12 lies horizontally. In the present example, this occurs when the body 20 is held upright. It will be appreciated, however, that the horizontal plane P may be formed by the disc 12 and/or pathway 52 when the body is held at other angles relative to horizontal. For example, the body 20 may be turned ninety degrees to place the pathway 48 and disc 12 horizontally when the body 20 is configured to launch the disc 12 while the disc stands on its thin outer rim 14.

Also in the loaded state, the actuator 26 aligns with the pathway 52, the space 48, and in turn, a loaded disc 12 in the space 48 in order to engage the projectile 12 to move the projectile forward along the pathway 52. So aligned, a stack 58 of discs 12 (shown in dashed line in FIG. 5) may optionally be piled in the loading bore 42 so that when the actuator 26 launches the bottom-most disc 12 in the stack 58, the next bottom-most disc 60 in the stack 58 will drop into the space 48 when the actuator 26 retracts out from under the loading bore 42.

In order to provide a strong launching force, at least two pinching members 28 and 30 are spaced forwardly along the pathway 52 from the actuator 26. The pinching members 28 and 30 are separate from, and movable relative to, the actuator 26 and the sidewall 46. Also, the pinching members 28 and 30 are disposed on opposite lateral sides of the pathway 52. With this configuration, the pinching members 28 and 30 receive the projectile 12 advanced into or along the pathway 52 by the actuator 26. The actuator 26 provides the projectile 12 with a sufficient force so that a certain portion of the projectile 12 squeezes passed the pinching members 28 and 30 as explained in greater detail below. The pinching members 28 and 30 then apply a further force on the projectile 12 as the projectile passes between the pinching members.

In one form, at least one of the pinching members 28 and/or 30 is resilient and has a natural state. The lateral distance, relative to the pathway 52, between the pinching members 28 and 30 in the natural state is less than the maximum width of the projectile 12. With this configuration, one or both of the pinching members 28 and 30 will move outward as the projectile squeezes between the pinching members. In order for this mechanism to work, the projectile 12 may have an outer rim or periphery that widens and then narrows in a top view of the projectile and as the projectile extends from its front to its rear. The illustrated projectile 12 provides a circular or curved outer rim 14 on the disc for a smooth launch of the disc. Other shapes, however, could be used such as a square or diamond shape where the projectile leads with one of its corners in that case.

Once the widest part of the projectile 12 passes the pinching members 28 and 30, the pinching members 28 and 30 will move relatively quickly back toward its original or natural state while asserting a pinching force on the projectile 12, and in one form, snaps back to its natural state to apply a relatively strong pinching force on the projectile 12. Due to the curvature or angle of the disc's outer rim 14, the asserted force may have a forwardly directed force component to strongly urge the projectile forward along the pathway 52 and out of the slot 32 for launching of the projectile.

It will be understood that one or both of the pinching members 28 and 30 may be configured to simply bend generally laterally away from and toward the pathway 52 to engage the projectile 12 as it moves between the pinching members 28 and 30. In the illustrated form, however, the pinching members 28 and 30 are configured to twist or rotate in order to provide the pinching force.

Specifically, the pinching members 28 and 30 are elongated in a direction indicated at t which also indicates the longitudinal axis of the pinching members on FIG. 5. The direction or axis t is transverse to horizontal while the pathway 52 is held in a horizontal plane P as described above. While it may be sufficient for only one of the pinching members 28 or to twist to adequately pinch the projectile 12 between the pinching members 28 and 30, in the illustrated form both pinching members twist to launch the projectile 12. Thus, at least one, but here both, of the pinching members 28 and 30 are formed by a torque pin or post 62 generally extending transverse to the horizontal plane P of the pathway 52.

Referring to FIG. 5, the post 62 has an upper end portion 66 rotationally fixed relative to the body 20 in a generally cylindrical upper boss 68 on the upper piece 22. Both the upper boss 68 and the upper end portion 66 have a corresponding D-shaped transverse cross-section so that the upper boss 68 and upper end portion 66 engage in a flat that limits rotation of the post 62 at the upper end portion 66. The upper end portion 66 may be secured within the upper boss 68 by a friction fit, snap-fit, adhesive, welding, or fastener for example. Additionally, the post 62 has a generally U-shaped transverse cross-section (indicated at U in dashed line on FIG. 8) on a majority of the length of the post 62, for one example, in order to achieve high quality molding of the post 62. Specifically, omitting a core in the center of the U-shaped post 62 causes the entire post to cool and solidify more rapidly once ejected from the mold which avoid sinks on the post surface that can be caused by contraction of a slower cooling core. The reduction in cross-sectional area also serves to reduce the amount of force needed to twist the post 62. Alternatively, the post 62 may have a circular transverse cross-section or any other shape as long as the upper end portion of the post 62 is rotationally fixed to the upper piece 22 and a lower end portion 70 of the post is free to twist or rotate about the longitudinal axis t of the post 62 (FIG. 5).

The lower end portion 70 of each post 62 extends into a lower cylindrical boss 72 on the lower piece 24. The lower boss 72 holds the lower end portion 70 relatively loosely so that the lower end portion 70 is generally or substantially laterally fixed relative to the body 20 and pathway 52 but is free to rotate within the lower boss 72. Alternatively, the lower boss 72 may be omitted, and the lower end portion 70 may be free to move laterally as well as rotate.

The posts 62 each have at least one lateral projection 64 for engaging the projectile 12. The posts 62 each may have two projections 64 so that it does not matter which side (left or right) of the pathway 52 the post 62 is placed even though just the inner lateral projection 64 on each post 62 may be used to engage the projectile 12. Each of the lateral projections 64 may be generally shaped as a trapezoidal flag which narrows as it extends distally although many other shapes would be adequate.

Figure 7:
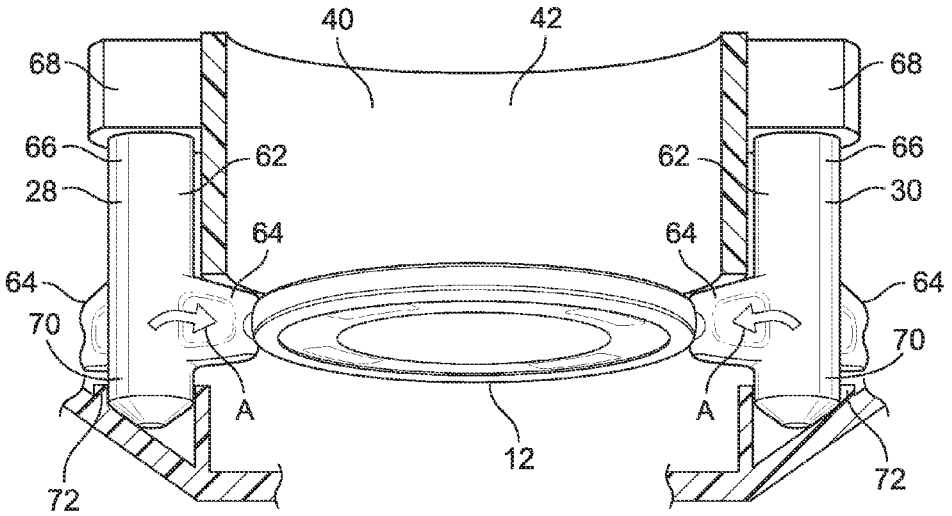
FIG. 7 is a fragmentary view showing a projectile and the pinching members during a firing stage.
Figure 8:
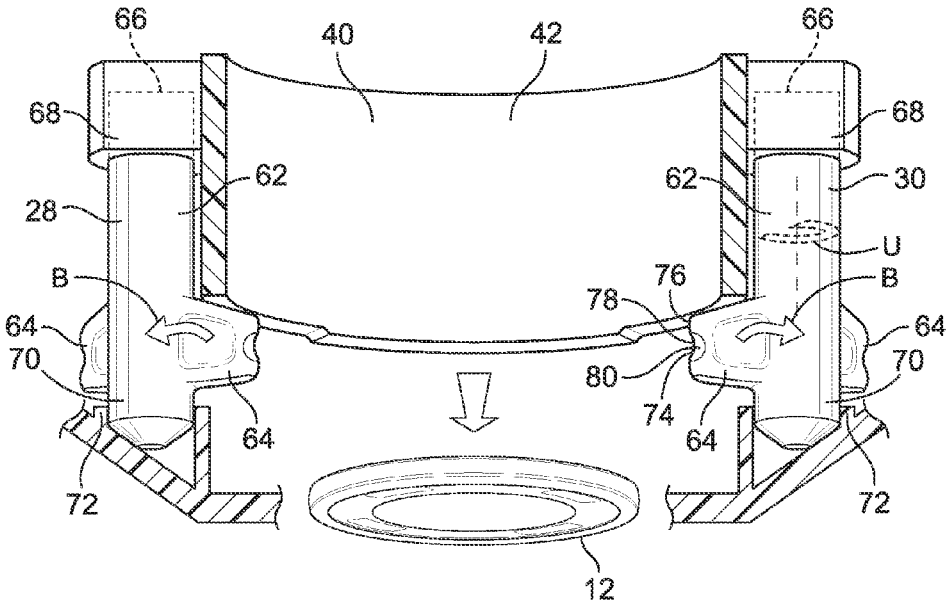
FIG. 8 is a fragmentary view showing a projectile and the pinching members during a subsequent firing stage from that of FIG. 7.

Referring to FIGS. 7-8, the pinching members 28 and 30 are resilient as mentioned above and are biased to a natural state. Thus, in operation, the actuator 26 advances the projectile 12 with sufficient strength so that the projectile engages the lateral projections 64 which causes the lateral projections 64 to rotate outwardly or, in other words, forwardly and then in opposite lateral directions away from the pathway 52 as shown by arrow A (FIG. 7). This provides clearance for the projectile 12 to move forward between the lateral projections 64 and creates potential energy for the lateral projections 64 to swing back to their natural state. The actuator 26 advances the projectile 12 forward with sufficient strength so that the widest part of the projectile 12 passes the lateral projections 64.

Once the width of the projectile 12 begins to narrow at the pinching members 28 and 30 as the projectile moves forward along the pathway 52, the lateral projections 64 swing relatively quickly or snap back toward their natural state (as shown by arrow B on FIG. 8) to apply a relatively strong pinching force on the projectile 12. Such engagement between the lateral projections 64 and the projectile 12 as the lateral projections 64 rotate back to their natural state causes the projectile to be launched along the pathway 52 and out of the exit slot 32.

In another aspect, each lateral projection 64 may have a guide 74 for engaging the projectile 12 and guiding or directing the projectile to retain the projectile along the pathway 52 and headed toward the exit slot 32. The guide 74 is located at a distal end 76 of the lateral projection 64 and has an indent 78 for receiving the projectile 12. The indent 78 is shaped to correspond to a shape of the outer rim 14 of the projectile 12. In one example, the indent 78 has a concave surface 80 that curves as the indent 78 extends transversely to the pathway 52 (or in other words, the indent 78 curves in a vertical direction when the body 20 orients the pathway 52 to extend in the horizontal plane P). The curve of the indent 78 corresponds to the curve of the outer rim 14 of the disc 12 to limit tilting of the disc 12 relative to the lateral projection 64 and in turn the pathway 52.

With this configuration, the pinching force is generated and concentrated on the pinching members 28 and 30 and near the area of contact with the projectile. This may provide a stronger force than that generated by known C-shaped pinching members assuming a similar material is used. Such C-shaped pinching members distribute the pinching force over the relatively long arms of the 'C' to apply the pinching force which may readily and undesirably disperse some of the pinching force. Thus, the present configuration may provide a stronger pinching force or may be able to provide a similar pinching force with a weaker, less expensive material.

It will be appreciated that alternative structure may be used to bias the posts 64 instead of using resilient material. For instance, the lateral projection on a solid post may be biased toward the projectile 12 by a torsion spring.

Referring again to FIGS. 2-4, the relatively stronger pinching force generated at the pinching members 28 and 30 permit the actuator 26 to be pressed with relatively smaller force for operation by a small child while still providing a strong and lengthy flight for the projectile to provide a highly entertaining toy. In the illustrated form, the actuator 26 includes a plunger 82 translatably mounted on the body 20. The plunger 82 has a main portion or shaft 84 with a distal end 86 for engaging the projectile 12 and a biasing portion 88 to bias the plunger 82 rearwardly away from the space 48. In one form, the biasing portion 88 and the main portion 84 are integrally formed as one piece. For example, the main portion 84 and the biasing portion 88 may be formed together in a single mold. In the alternative, the plunger 84 may be formed by other methods where the biasing portion 88 is otherwise permanently secured to the main portion 84.

In one form, the biasing portion 88 has at least one, but here two, resilient arms 90 each extending on opposite sides of the main portion 84. In the illustrated form, the resilient arms 90 are connected to the main portion via a laterally extending flange 94. The resilient arms 90 each have a proximal end portion 92 respectively fixed at opposite end portions 96 and 98 of the flange 94 while the main portion 84 extends from a center portion 100 of the flange 94. In this way, the resilient arms 90 are fixed relative to the main portion 84.

Figure 9:
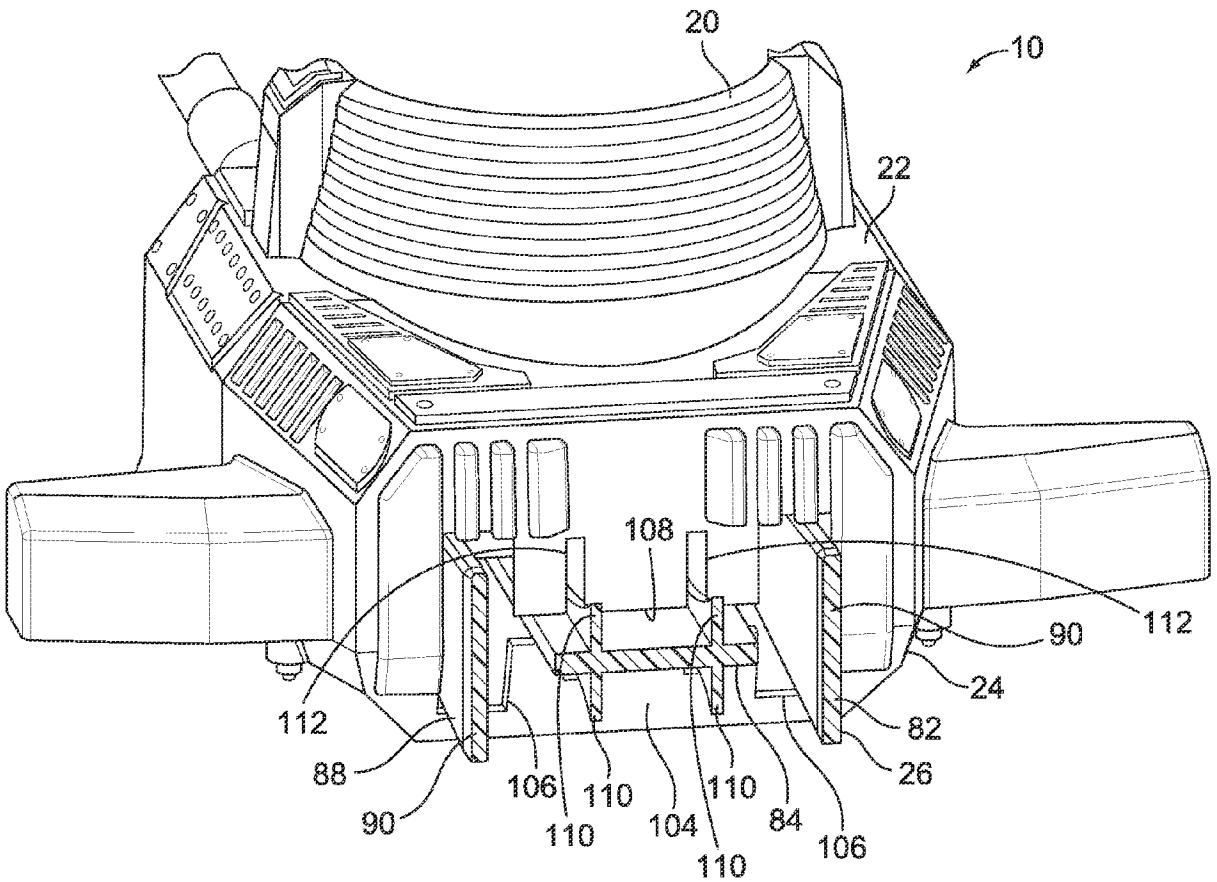
FIG. 9 is a rear perspective view of the projectile shooter toy with a portion of a plunger cut away to show the rear of the projectile shooter toy.

The flange 94 may also be used as an activation button 102 on the plunger 84. Specifically, the button 102 should be accessible to a user from the exterior of the body 20 in order to activate the plunger 82. In the illustrated form, the button 102 is disposed exteriorly to a rear wall 104 of the body 20 while the main portion 84 as well as the resilient arms 90 extend from the button 102 (or flange 94) and into the body 20 through slits 106 and 108 on the rear wall 104 of the body 20 as shown in FIG. 9. The main portion 84 also has transverse flanges 110 that extend though slits 112 (FIG. 9). The main portion 84, resilient arms 90, and flanges 110 may slide forward and retract through the slits 106, 108, 112. In addition to facilitating the translation of the plunger 82, this structure may limit the lateral motion of the plunger 82 to maintain the plunger pointed toward the space 48 and parallel to the pathway 52.

In order to further maintain alignment of the main portion 84 with the space 48 and the pathway 52, the main portion 84 has a longitudinally extending slot 114 that slides along a pin or column 116. The column 116 extends from the upper or lower pieces 22 or 24. In one form, both pieces 22 and 24 have a column 116 and 118 respectively that connect together to lock the main portion 84 thereon while permitting the plunger 82 to slide along the columns 116 and 118 as shown in FIG. 2.

The button 102 is relatively wide so that it may be easy to press by a small child. Pressing the button 102 forward toward the body 20 causes the main portion 84 to engage the projectile and move the projectile 12 forward between the pinching members 28 and 30, which then launches the projectile 12 along the pathway 52 and out of the exit slot 32. As mentioned above, the shooter toy 10 is also made easier to operate by a small child since the button 102 need only be pressed until the widest part of the projectile 12 passes the pinching members 28 and 30. The force to accomplish this may be considerably less than the pinching force applied to the projectile 12 by the pinching members 28 and 30 to launch the projectile 12 with an entertaining trajectory and velocity.

Figure 3:
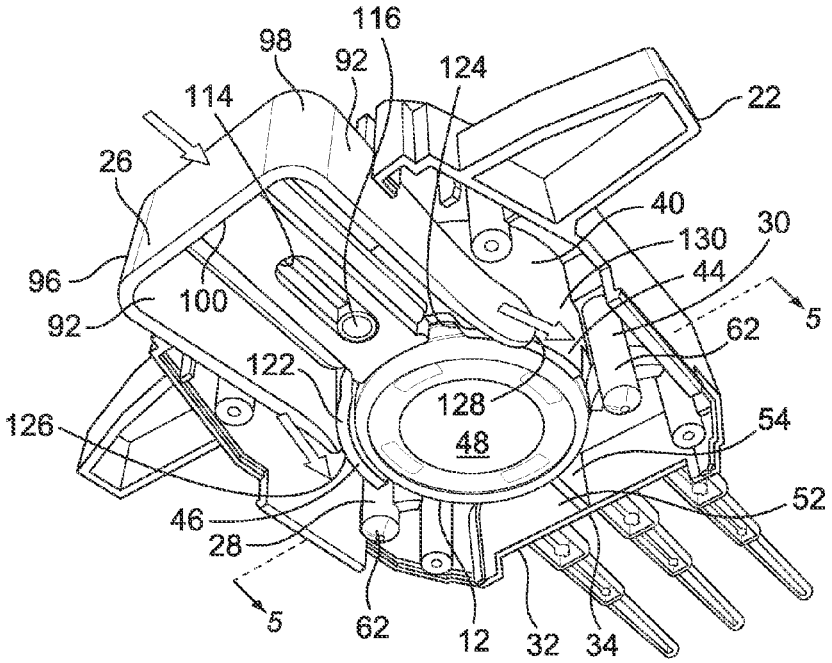
FIG. 3 is a lower perspective view of the projectile shooter toy with a bottom piece removed to show the projectile shooter toy in a loaded state.

Referring to FIGS. 3-4, in order to create the biasing action of the plunger 82, the resilient arms 90 each have a contact portion 120 forwardly of the proximal end portions 92 of the resilient arms 90. The contact portions 120 engage the sidewall 42 to bias the plunger 82 rearwardly and away from the space 48. The contact portion 120 may be a distal end portion of the resilient arm 90 in one example. Each contact portion 120, in one form, may be a free end and is curved laterally outward so that the plunger 82 receives the curved or cylindrical sidewall 46 between the two resilient arms 90. The sidewall 46 has a lower rim 122 with a gap 124. The plunger 82 is arranged to move within, and specifically extend and retract through, the gap 124 while the resilient arms 90 engage the exterior 130 of the sidewall 46 respectively on opposite sides 126 and 128 of the gap 124.

The natural state (FIG. 3) of the resilient arms 90 is laterally inward (toward the pathway 52 or the center of the space 48) where the resilient arms 90 extend generally perpendicular from the flange 94. In use, when the plunger 82 is pressed forward, the resilient arms 90 slide forward and against the sidewall 46, which causes the resilient arms 90 to bend laterally outward as shown in FIG. 4. This action against the bias of the resilient arms stores potential energy so that as soon as the button 102 is released, the resilient arms 90 press laterally inward against the sidewall 46 which forces the plunger 82 and the main portion 84 to retract rearward and away from the space 48. This structure may eliminate the need for any type of separate return spring on the plunger 82.

In order to facilitate the resiliency described above, the actuator 26 and the pinching members 28 and 30 are made of an acetal such as POM (Polyoxymethylene) or similar material. In one form, such a material has a low wear characteristic with a lubricant built in. The upper and lower pieces 22 and 24 of the body 20, as well as the projectile 12, may be made by injection molding using plastic or thermoplastic such as ABS (Acrylonitrile Butadiene Styrene) as one example or similar material.

From the foregoing, a unique projectile shooter toy is provided with an actuator that has integral biasing portions to reduce the cost of the actuator while providing a shooter toy that requires little strength to use, and pinching members that provide a strong force for launching the projectile. While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A projectile shooter toy, comprising:

a body having a sidewall forming a space for holding a disc shaped projectile in a loaded state and a pathway leading away from the space and along which the projectile moves in a forward direction;

an actuator arranged to engage the projectile to move the projectile forward along the pathway; and at least two pinching members spaced forwardly along the pathway from the actuator where two pinching members are identical, the at least two pinching members being separate from the sidewall, the pinching members each comprising a post forwardly along the pathway with a lateral guide portion engaging the projectile and configured to exert a launching force where a return force of the pinching members is the launching force acting on the projectile as the projectile passes between the at least two pinching members.

2. The projectile shooter toy of claim 1 wherein when the body is oriented so that the pathway extends horizontally, the at least two pinching members are elongated in a transverse direction to horizontal.

3. The projectile shooter toy of claim 1 wherein at least one of the pinching members is an elongate post having at least one lateral projection for engaging the projectile.

4. The projectile shooter toy of claim 3 wherein the body is configured to anchor the post so that the lateral projection rotates as the projectile engages and moves passed the post.

5. The projectile shooter toy of claim 3 wherein the post comprises one end portion rotationally fixed relative to the body and an opposite end portion near the lateral projection and substantially laterally fixed relative to the body and free to rotate.

6. The projectile shooter toy of claim 3 wherein the pinching member is resilient and has a natural state, and wherein an engagement between the lateral projection and the projectile as the lateral projection rotates back to the natural state causes the projectile to be launched along the pathway and out of the body.

7. The projectile shooter toy of claim 3 wherein the lateral projection comprises a guide for engaging the projectile and directing the projectile to remain along the pathway.

8. The projectile shooter toy of claim 3 wherein the lateral projection has a distal end with an indent for receiving the projectile.

9. The projectile shooter toy of claim 8 wherein the indent is shaped to correspond to a shape of an outer rim of the projectile.

10. The projectile shooter toy of claim 8 wherein when the indent is arranged so that when the body is oriented for the pathway to extend horizontally, the indent has a concave surface that curves as the indent extends in a vertical direction.

11. The projectile shooter toy of claim 1 wherein at least one of the pinching members is resilient and has a natural state, and wherein the distance between the pinching members in the natural state is less than the maximum width of the projectile.

12. The projectile shooter toy of claim 1 wherein the actuator is a plunger translatably mounted on the body and with a main portion having an end for engaging the projectile and a biasing portion biasing the plunger rearwardly away from the space, wherein the biasing portion and the main portion are integrally formed as one piece.

13. The projectile shooter toy of claim 12 wherein the biasing portion comprises at least one resilient arm having a proximal end portion fixed relative to the main portion and an opposite free end portion configured to engage the sidewall to bias the plunger away from the space.

14. The projectile shooter toy of claim 13 wherein the opposite free end portion is configured to slide against the sidewall.

15. A projectile shooter toy, comprising:

a body forming a space for holding a disc shaped projectile in a loaded state and a pathway leading away from the space and along which the projectile moves in a forward direction;

an actuator having a plunger arranged to engage the projectile to move the projectile from the space and forward along the pathway; and two identical pinching members having resilient arms integrally formed with a fixed post spaced forwardly along the pathway from the actuator and generally extending transverse to a horizontal plane while the body is held so the pathway generally extends along the horizontal plane, the arms configured to engage the projectile as the actuator moves the projectile forward along the pathway where the projectile forces the arms outwardly and as the projectile passes between the arms they release stored energy to launch the projectile as the arms return to their natural state.

16. The projectile shooter toy of claim 15 wherein the arms comprise at least one projection extending laterally from the post for engaging and exerting a force on the projectile.

17. The projectile shooter toy of claim 16 wherein the projection comprises an indent for receiving the projectile and that is shaped to guide the projectile to remain along the pathway.

18. A projectile shooter toy comprising:

a body having a sidewall forming a space for holding a disc shaped projectile in a loaded state and a pathway leading away from the space and along which the projectile moves in a forward direction;

two identical pinching members each comprising a post, one each spaced on each side of the pathway separate from the sidewall; and an actuator having a plunger for moving the projectile from the space and forward along the pathway towards the pinching members to engage the projectile and exert a launching force where a return force of the pinching members is the launching force on the projectile as the projectile passes between the two pinching members, the plunger having a main portion with an end for engaging the projectile and a biasing portion biasing the plunger rearwardly away from the space, wherein the biasing portion and the main portion are integrally formed as one piece.

19. The projectile shooter toy of claim 18 wherein the biasing portion comprises at least one resilient arm having one proximal end portion fixed to the main portion and a contact portion arranged to engage the sidewall to bias the plunger.

20. The projectile shooter toy of claim 18 wherein the plunger comprises two resilient arms on opposite sides of the main portion, said sidewall having an upper rim and a gap therein, with the plunger being arranged to extend through the gap and the resilient arms being arranged to engage the sidewall respectively on opposite sides of the gap.

* * * * *